US007040290B2

(12) United States Patent
Kim

(10) Patent No.: US 7,040,290 B2
(45) Date of Patent: May 9, 2006

(54) COMMON RAIL SYSTEM

(75) Inventor: Hyoung Shin Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 76 days.

(21) Appl. No.: 10/747,000

(22) Filed: Dec. 23, 2003

(65) Prior Publication Data

US 2005/0115544 A1 Jun. 2, 2005

(30) Foreign Application Priority Data

Oct. 27, 2003 (KR) ..... 10-2003-0074974

(51) Int. Cl.
*F02M 41/00* (2006.01)

(52) U.S. Cl. ..... 123/456; 123/514

(58) Field of Classification Search ..... 123/456, 123/457, 468, 469, 514, 447
See application file for complete search history.

(56) References Cited

U.S. PATENT DOCUMENTS 5,207,203 A * 5/1993 Wagner et al. ..... 123/514
5,359,976 A * 11/1994 Nakashima et al. ..... 123/516
5,577,479 A * 11/1996 Popp ..... 123/458
5,732,679 A * 3/1998 Takahasi et al. ..... 123/467
6,000,380 A * 12/1999 Weisbarth ..... 123/456
6,499,466 B1 * 12/2002 Lee ..... 123/456

FOREIGN PATENT DOCUMENTS

| | | |
|---|---|---|
| DE | 4335171 | 5/1995 |
| DE | 19727413 | 1/1999 |
| EP | 0 699 835 A1 | 6/1996 |
| FR | 2845129 A1 * | 4/2004 |
| JP | 04-330373 | 11/1992 |

* cited by examiner

*Primary Examiner*—Mahmoud Gimie
(74) *Attorney, Agent, or Firm*—Morgan Lewis & Bockius LLP

(57) ABSTRACT

A common rail system includes a first common rail, a second common rail, and a control unit. The first common rail is connected to a fuel pump through a fuel feed line and is provided with a first pressure regulating valve and a first pressure sensor. The second common rail is connected to the first common rail through a connecting line and is provided with a second pressure regulating valve and a second pressure sensor. The control unit controls operation of the fuel pump based on signals input from the first and second pressure sensors.

2 Claims, 2 Drawing Sheets

COMMON RAIL SYSTEM

CROSS-REFERENCE TO RELATED APPLICATIONS

This application claims priority of Korean Application No. 10-2003-0074974, filed on Oct. 27, 2003.

FIELD OF THE INVENTION

The present invention relates to a common rail system, and more particularly, to a common rail system having at least two common rails.

BACKGROUND OF THE INVENTION

In a diesel engine, high pressure fuel injection is required in order to improve engine performance and fuel economy and to reduce exhaust emissions. In recent common rail systems, the maximum pressure of injected fuel is about 1800 to 2000 bar. In such systems, high pressure fuel that is pressurized by a high pressure fuel pump is supplied to a common rail through a fuel pipe, and fuel in the common rail is injected through a fuel injector according to control of an engine control unit (ECU).

In general, fuel pumped by a fuel pump is supplied to a common railt through a fuel feed line. Fuel is supplied to each fuel injector from the common rail and the fuel is then injected into combustion chambers at a high pressure. The fuel injector typically includes a solenoid, an anchor bolt, an anchor plate, a ball, a nozzle spring, a valve spring, a valve piston, a needle, or the like. The needle undergoes vertical movement according to operation of the solenoid, and the fuel injector injects fuel according to the vertical movements of the needle. Therefore, through control of the solenoid, fuel injection timing, an amount of injected fuel, and injection times, the fuel injection can be controlled.

However, because a high fuel pressure is maintained in such a common rail system, fuel is suddenly injected even in an early stage of engine starting. Therefore, an ignition delay may occur and knocking noise increases, and temperature in the combustion chamber may substantially increase so that exhaust gas (e.g., NOx) is increased.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Embodiments of the present invention provide a common rail system having two common rails in which sudden fuel injection due to a change of fuel pressure in an early stage of engine starting can be prevented, and accordingly pulsating noise can be decreased and incomplete burning of fuel can also be prevented, and the temperature in a combustion chamber can be kept from rising too high.

In a preferred embodiment of the present invention, the common rail system comprises a first common rail, a second common rail, and a control unit. The first common rail is connected to a fuel pump through a fuel feed line and is provided with a first pressure regulating valve and a first pressure sensor. The first pressure regulating valve is configured to regulate pressure of fuel in the first common rail, and the first pressure sensor detects pressure in the first common rail and outputs a corresponding signal. The second common rail is connected to the first common rail through a connecting line and is provided with a second pressure regulating valve and a second pressure sensor. The second pressure regulating valve is configured to regulate pressure of fuel in the second common rail, and the second pressure sensor detects pressure in the second common rail and outputs a corresponding signal. The control unit controls an operation of the fuel pump based on signals input from the first and second pressure sensors.

It is preferable that an area of a section of the connecting line gradually decreases as the section approaches the second common rail.

It is also preferable that a size of the second common rail is less than that of the first common rail.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
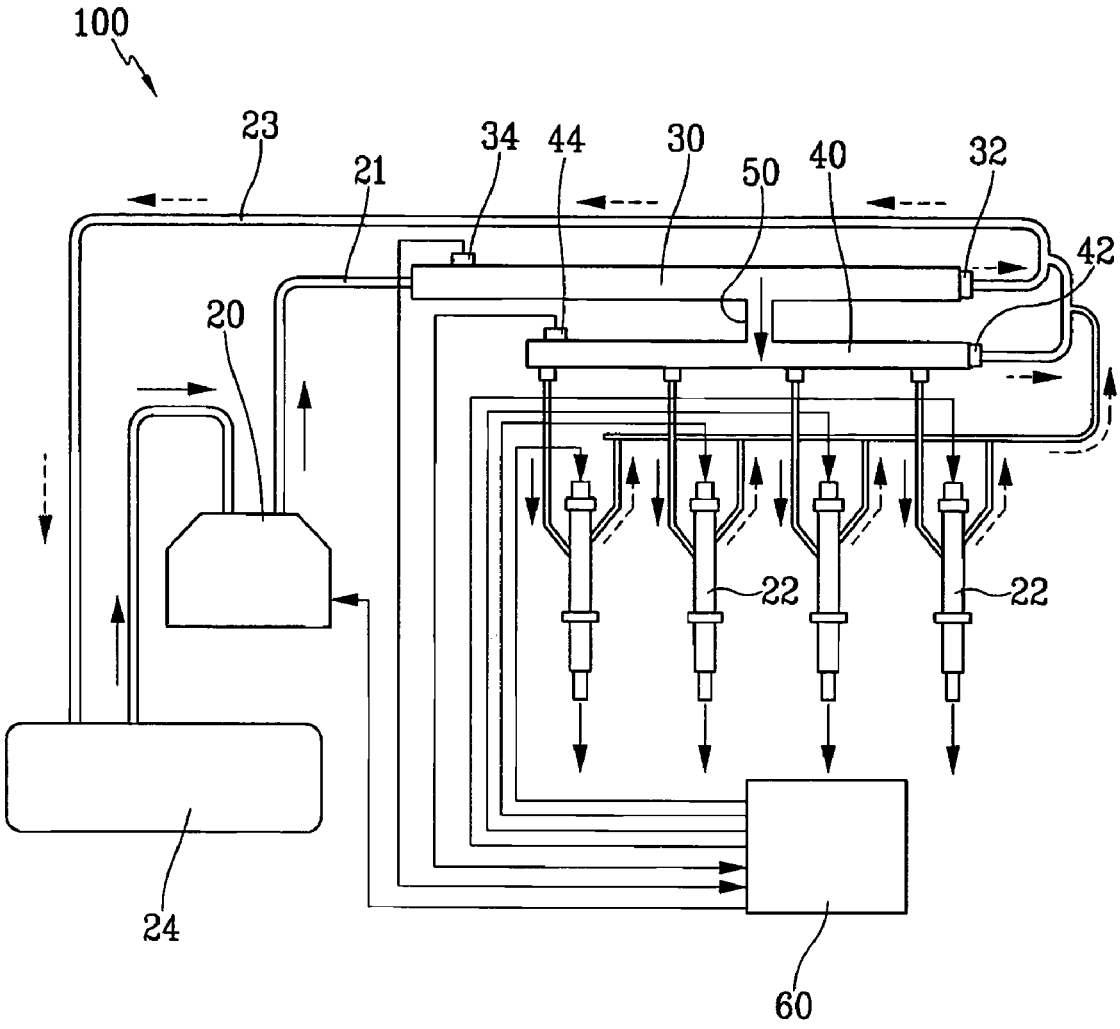
FIG. 1 schematically shows a common rail system according to the preferred embodiment of the present invention.

In FIG. 1, a reference numeral 100 designates a common rail system according to an embodiment of the present invention. The common rail system 100 has two common rails, i.e., a first common rail 30 and a second common rail 40. The first and second common rails 30 and 40 are connected together through a connecting line 50. Preferably, the connecting line 50 is connected to each of the first and second common rails 30 and 40 at their centers.

Figure 2:
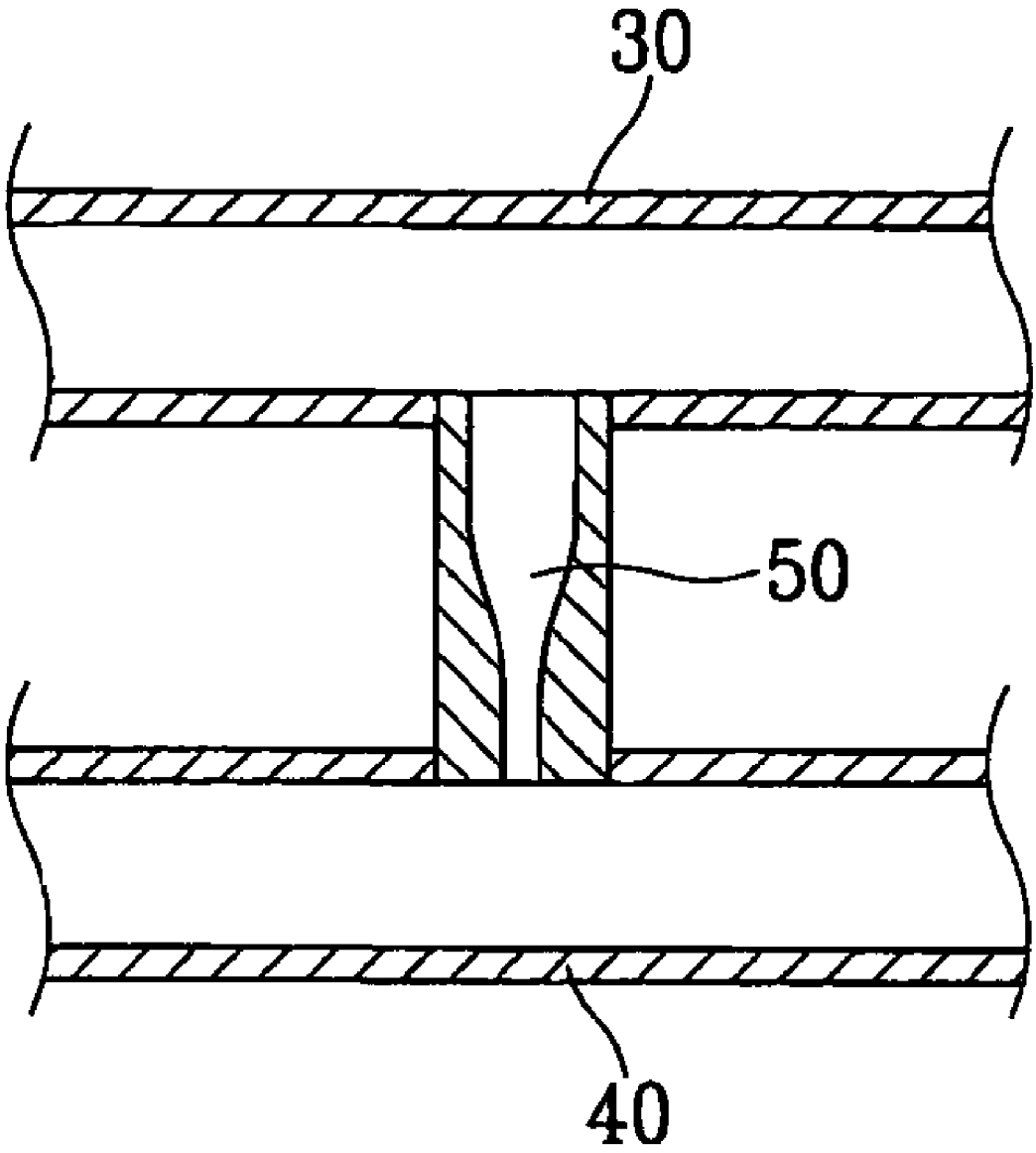
FIG. 2 is a sectional view of a connecting line of the common rail system of FIG. 1.

In particular, an inner diameter of the connecting line 50 preferably is reduce as it approaches the second common rail 40, as shown in FIG. 2, so that a pressure wave generated in the second common rail 40 can be prevented from being transmitting to the first common rail 30 by way of the connecting line 50. That is, an area of a section of the connecting line 50 gradually decreases as the section approaches the second common rail 40.

The first common rail 30 is provided with a first pressure regulating valve 32 and a first pressure sensor 34, and the second common rail 40 is provided with a second pressure regulating valve 42 and a second pressure sensor 44.

If pressure of fuel in the first common rail 30 is higher than a predetermined value, the fuel is returned to a fuel tank 24 through a fuel return line 23, so that the pressure in the first common rail 30 is regulated. Similarly, if pressure of fuel in the second common rail 40 is higher than a predetermined value, the fuel is returned to the fuel tank 24 through the fuel return line 23, so that the pressure in the second common rail 40 is regulated.

The first pressure sensor 34 detects pressure of fuel in the first common rail 30 and outputs a corresponding pressure signal to an electronic control unit 60, and the second pressure sensor 44 detects pressure of fuel in the second common rail 40 and outputs a corresponding pressure signal to the electronic control unit 60.

The electronic control unit 60 controls an operation of a fuel pump 20 on the basis of signals input from the first and second pressure sensors 34 and 44. The electronic control unit 60 may comprise a processor and associated hardware as may be selected and programmed by a person of ordinary skill in the art based on the teachings of the present invention.

At least one fuel injector 22 is connected to the second common rail 40. Fuel is supplied to the fuel injector 22 from the second common rail 40, and the fuel injector 22 is controlled by the electronic control unit 60 to inject fuel.

The fuel pump 20 is connected to the first common rail 30 through a fuel feed line 21 so that pressurized fuel is supplied to the first common rail 30. The remaining fuel that has not been injected and resides in the fuel injector 22 is returned to the fuel tank 24 through the fuel return line 23.

The size of the second common rail 40 is preferably less than that of the first common rail 30. Because the pressure change of fuel flowing into the second common rail 40 has already stabilized when the fuel passes the first common rail 30, the size of the second common rail 40 can be decreased. Furthermore, it is preferable that the amount of fuel returned to the fuel tank 24 through the second pressure regulating valve 42 is less than the amount of fuel returned to the fuel tank 24 through the first pressure regulating valve 42, so that more precise pressure control is possible in the second common rail 40.

Hereinafter, operations of the common rail system 100 according to an embodiment of the present invention will be explained.

If the fuel pump 20 is driven while the engine is being started, fuel pumped by the fuel pump 20 is supplied to the first common rail 30 through the fuel feed line 21. The pressure of the fuel supplied to the first common rail 30 is firstly regulated by the fist pressure regulating valve 32, and the fuel is then supplied to the second common rail 40 through the connecting line 50. The pressure of the fuel supplied to the second common rail 40 is secondly regulated by the second pressure regulating valve 42.

The fuel supplied to the second common rail 40 is then injected into combustion chambers by the fuel injector 22 according to control by the electronic control unit 60.

The common rail system 100 according to the preferred embodiment of the present invention includes two common rails 30 and 40, and therefore a sudden fuel injection due to a change of a fuel pressure in an early stage of an engine starting can be prevented. Accordingly, the pulsating noise can be decreased and incomplete burning of fuel can also be prevented, and a temperature in a combustion chamber can be kept from rising too high.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A common rail system, comprising:

a first common rail connected to a fuel pump through a fuel feed line and provided with a first pressure regulating valve and a first pressure sensor, the first pressure regulating valve being configured to regulate pressure of fuel in the first common rail, the first pressure sensor detecting pressure in the first common rail and outputting a corresponding signal;

a second common rail connected to the first common rail through a connecting line and provided with a second pressure regulating valve and a second pressure sensor, the second pressure regulating valve being configured to regulate pressure of fuel in the second common rail, the second pressure sensor detecting pressure in the second common rail and outputting a corresponding signal; and a control unit controlling operation of the fuel pump based on signals input from the first and second pressure sensors, wherein a section of the connecting line has a cross section gradually decreases in area as the cross section approaches the second common rail.

2. The common rail system of claim 1, wherein a size of the second common rail is less than that of the first common rail.

* * * * *